US008431851B2

(12) United States Patent
Shukla et al.

(10) Patent No.: US 8,431,851 B2
(45) Date of Patent: Apr. 30, 2013

(54) STRUCTURALLY ENHANCED SWITCH ASSEMBLIES

(76) Inventors: Ashutosh Shukla, Santa Clara, CA (US); Scott Myers, San Francisco, CA (US); Matthew Hill, Mountain View, CA (US); Mike Wittenberg, Cupertino, CA (US)

( * ) Notice: Subject to any disclaimer, the term of this patent is extended or adjusted under 35 U.S.C. 154(b) by 305 days.

(21) Appl. No.: 12/987,992

(22) Filed: Jan. 10, 2011

(65) Prior Publication Data

US 2012/0175232 A1 Jul. 12, 2012

(51) Int. Cl.
*H01H 3/12* (2006.01)

(52) U.S. Cl.
USPC ..... 200/341

(58) Field of Classification Search ..... 200/341, 200/329, 520, 314, 5 A, 343, 344, 521
See application file for complete search history.

(56) References Cited

U.S. PATENT DOCUMENTS 6,148,183 A * 11/2000 Higdon et al. ..... 455/575.1
7,576,291 B2 * 8/2009 Tseng et al. ..... 200/296
8,098,494 B2 * 1/2012 Li et al. ..... 361/752

* cited by examiner

*Primary Examiner* — Edwin A. Leon
(74) *Attorney, Agent, or Firm* — Kramer Levin Naftalis & Frankel LLP

(57) ABSTRACT

Slide switch assemblies with structural enhancements are provided for use in electronic devices. Slide switch assemblies in accordance with embodiments the invention can include a button, an engagement member, and switch box. The engagement member couples the button to the switch box and translates any movement of the button to the switch box. The switch box is mounted offset with respect to the button because another component such as, for example, a display screen occupies the space that would have been a better mounting position for the switch box. To compensate for the offset, and the added torsion that is applied to the engagement member during button movement events, the engagement member is structurally enhanced.

23 Claims, 12 Drawing Sheets

STRUCTURALLY ENHANCED SWITCH ASSEMBLIES

BACKGROUND OF THE DISCLOSURE

Electronic devices may include several types of input components that can be used by a user for providing instructions or commands to the electronic device. For example, the input component may be a switch assembly including a button that may be moved to one of at least two different positions. The button may be aligned with a slider that can slide along a linear track. Consequently, as the button is moved from one position to another, the movement of the button causes the slider to slide along the track. A switch box can be coupled to the slider via an engagement member that can detect mechanical movement of the slider and translate this movement into electrical signals. These electrical signals can then be interpreted by other components of an electronic device in order to alter a functional state of the device.

Depending on the position of the switch box relative to the button, the engagement member may be subject to stresses that can cause it to break during normal and intended use of the device. Accordingly, improved switch assembly structures are needed.

SUMMARY OF THE DISCLOSURE

Slide switch assemblies with structural enhancements are provided for use in electronic devices. Slide switch assemblies in accordance with embodiments the invention can include a button, an engagement member, and switch box. The engagement member couples the button to the switch box and translates any movement of the button to the switch box. The switch box is mounted offset with respect to the button because another component such as, for example, a display screen occupies the space that would have been a better mounting position for the switch box. To compensate for the offset, and the added torsion that is applied to the engagement member during button movement events, the engagement member is structurally enhanced.

BRIEF DESCRIPTION OF THE DRAWINGS

The above and other aspects of the invention, its nature, and various features will become more apparent upon consideration of the following detailed description, taken in conjunction with the accompanying drawings, in which like reference characters refer to like parts throughout, and in which.

DETAILED DESCRIPTION OF THE DISCLOSURE

Figure 1:
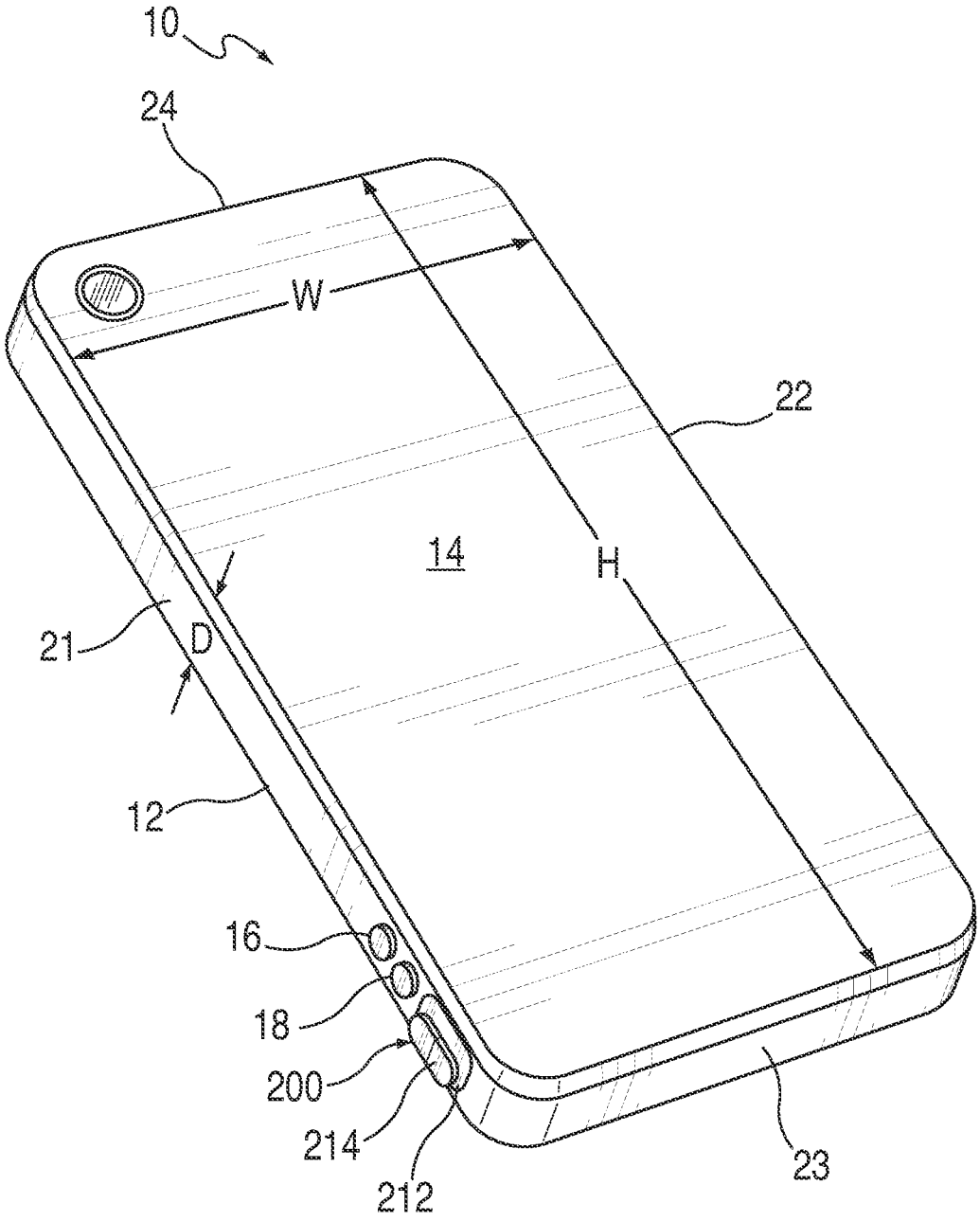
FIG. 1 is an illustrative bottom perspective view of an electronic device having a switch assembly in accordance with some embodiments of the invention.

FIG. 1 shows an illustrative perspective view of an electronic device 10 in accordance with an embodiment of the invention. Electronic device 10 may generally be any portable, mobile, hand-held, or miniature electronic device having a switch assembly. Miniature electronic devices may have a form factor that is smaller than that of hand-held personal media devices, such as an iPod™ Shuffle available by Apple Inc. of Cupertino, Calif. Illustrative miniature electronic devices can be integrated into various objects that include, but are not limited to, watches, rings, necklaces, belts, accessories for belts, headsets, accessories for shoes, virtual reality devices, other wearable electronics, accessories for sporting equipment, accessories for fitness equipment, key chains, or combinations thereof. Alternatively, electronic device 10 may not be portable at all.

Electronic device 10 may include at least one input component (see, e.g., buttons 16 and 18 and switch assembly 200 of FIG. 1) that can allow a user to manipulate at least one function of the device, at least one output component that can provide the user with valuable device generated information, and a housing (see, e.g., outer periphery member 12 and cover 14 of FIG. 1) that can at least partially enclose the one or more input components and the one or more output components of the device.

As shown in FIG. 1, for example, device 10 can be hexahedral and may include a top wall 23, a bottom wall 24 opposite top wall 23, a right side wall 22, a left side wall 21 opposite right side wall 22, a front wall (not shown), and a back wall 14 opposite front wall. Each of the walls of device 10 may be substantially flat (see, e.g., right side wall 21), though the contours of one or more of the walls of device 10 can be at least partially curved, jagged, or have any other suitable shape or combination thereof.

Generally, device 10 may be said to have a depth D that may be defined by the gap between back wall 14 and the front wall (not shown). Similarly, housing 400 may be said to have a width W that may be defined by the length between right side wall 22 and left side wall 21. Finally, device 10 may be said to have a height H that may be defined by the length between top wall 23 and bottom wall 24. It should be noted that the design of device 10 described above is only exemplary and need not be substantially hexahedral, and that, in certain embodiments, the intersects of certain walls may be beveled, and device 10 itself could generally be formed in any other suitable shape, including, but not limited to, substantially spherical, ellipsoidal, conoidal, octahedral, or a combination thereof, for example.

Figure 2:
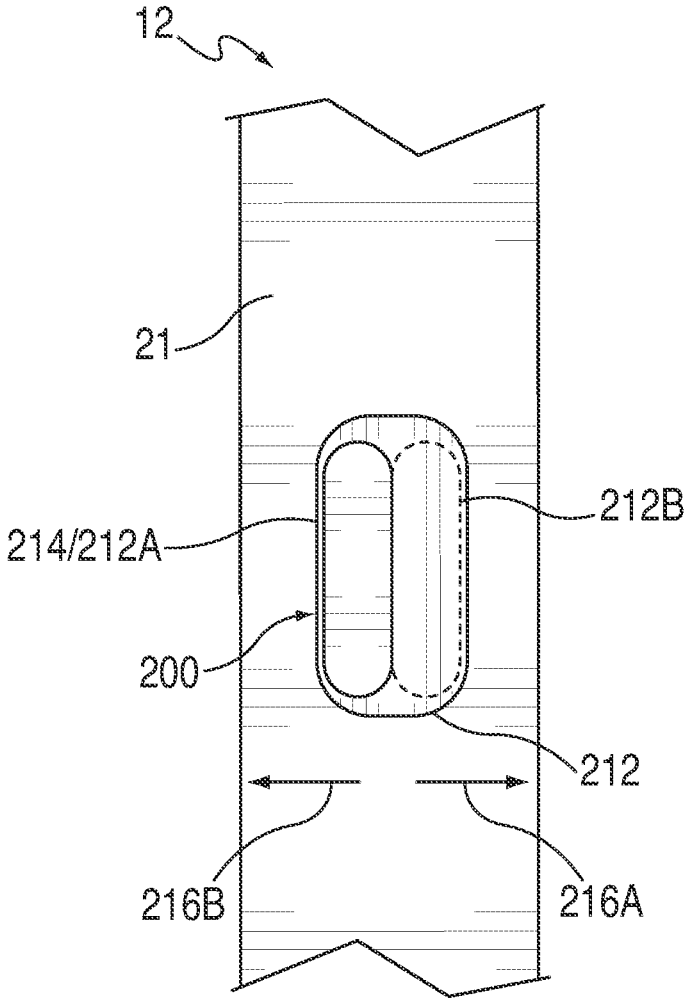
FIG. 2 is an illustrative left side view of a portion of the electronic device and switch assembly of FIG. 1 in accordance with some embodiments of the invention.

Electronic device 10 can include at least one switch assembly 200. As shown in FIGS. 1 and 2, for example, switch assembly 200 can include track 212 that is disposed along and through a portion of left side wall 21. It is to be understood that track 212 of switch assembly 200 may be provided along and through any portion of any wall or walls of device 10 and not just left side wall 21.

Switch assembly 200 may also include a button 214 that can slide within and along track 212 between at least two button positions to change a functional state of device 100 (e.g., to power the device up or to power the device down or to switch the ringer between a vibrate mode or a ring mode). For example, as shown in FIG. 2, button 214 may slide within track 212 between a first button position adjacent a first end 212A of track 212 and a second button position adjacent a second end 212B of track 212. In such embodiments, a user of device 100 can slide button 214 along track 212, either in the linear direction of arrow 216A away from the first button position adjacent first track end 212A and towards the second button position adjacent second track end 212B or in the linear direction of arrow 216B away from the second button position adjacent second track end 212B and towards the first button position adjacent first track end 212A. Additionally or alternatively, in some embodiments, button 214 may slide within track 212 from the first button position adjacent first track end 212A and/or from the second button position adjacent second track end 212B to a third button position (not shown) in between first track end 212A and second track end 212B to change a functional state of device 10.

Figure 3:
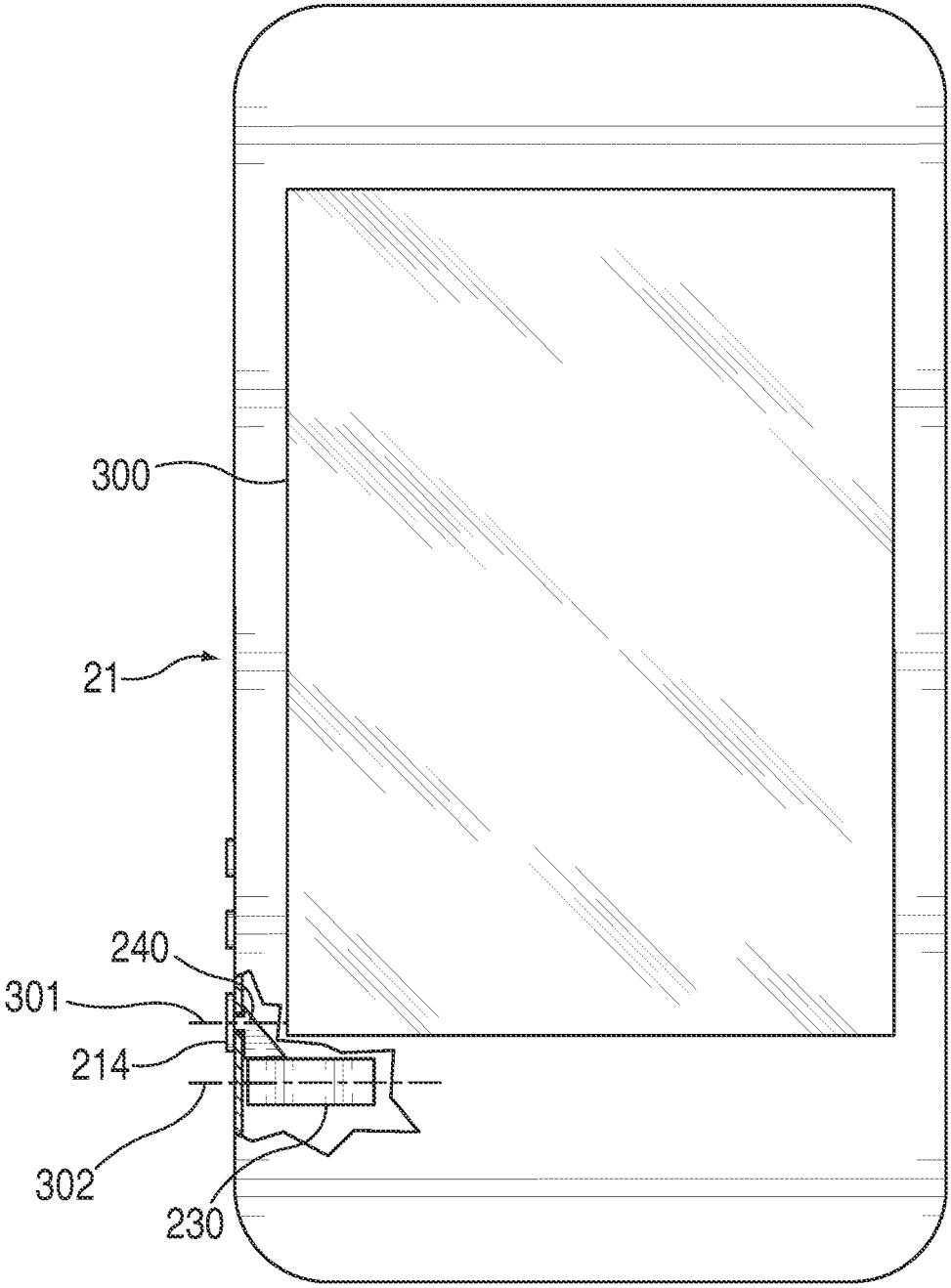
FIG. 3 is a simplified illustrative cross-sectional view of the portion of the electronic device and switch assembly of FIGS. 1 and 2 in accordance with some embodiments of the invention.
Figure 4:
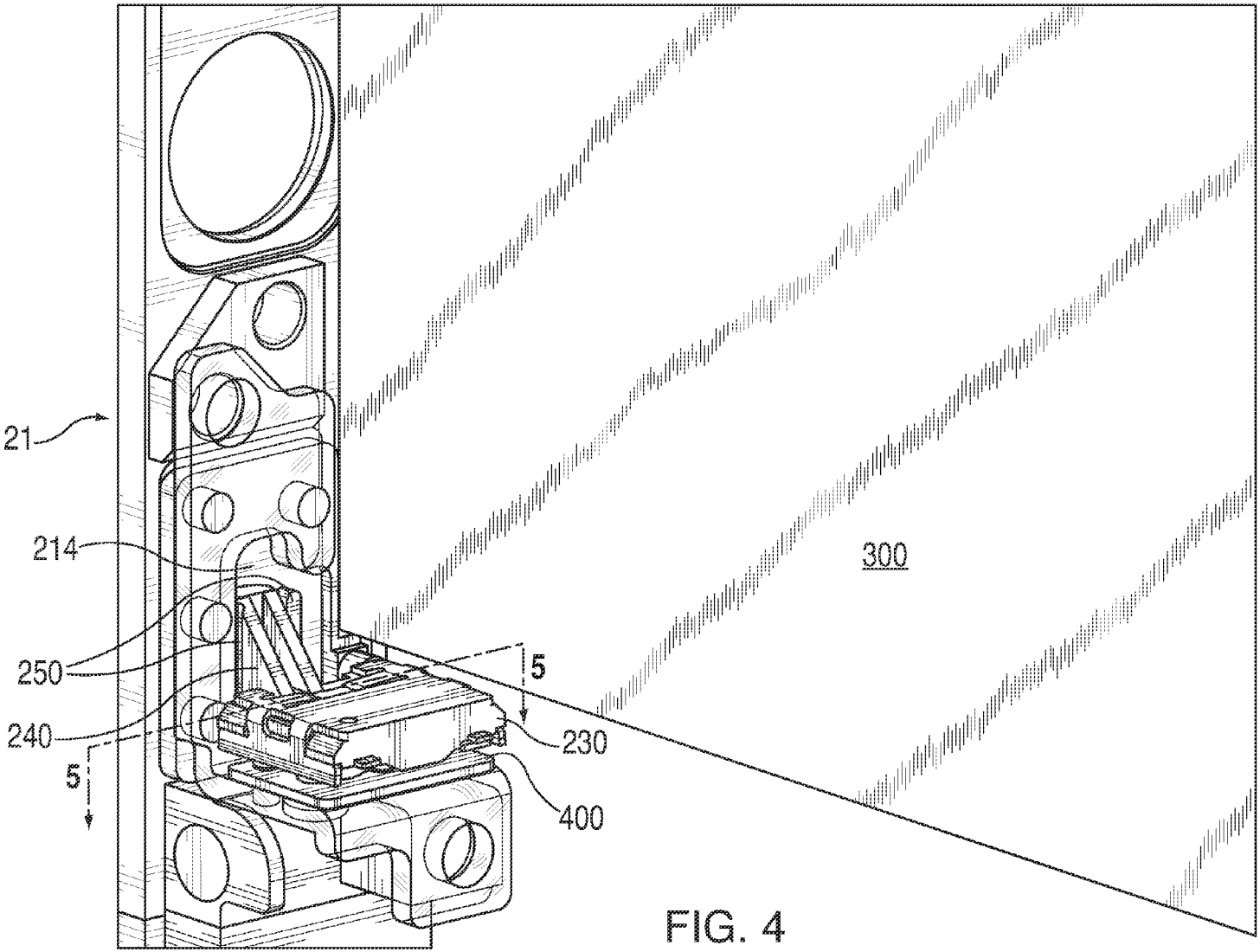
FIG. 4. is a simplified illustrative perspective view of an inside portion of the electronic device and switch assembly of FIGS. 1-3 in accordance with some embodiments of the invention.
Figure 5:
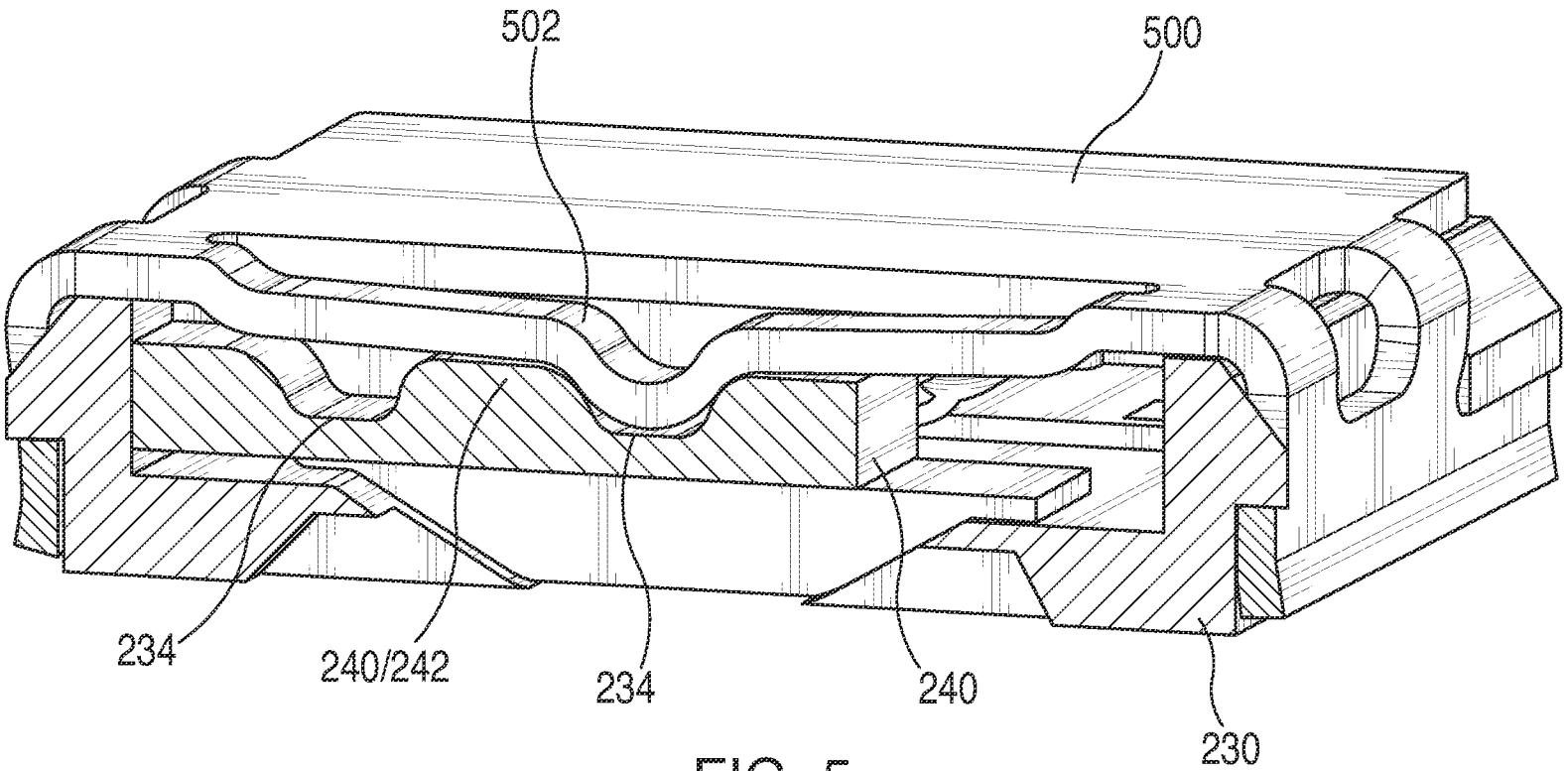
FIG. 5 is a simplified illustrative cross-sectional view of a switch box taken along lines A-A of FIG. 4 in accordance with some embodiments of the invention.
Figure 6:
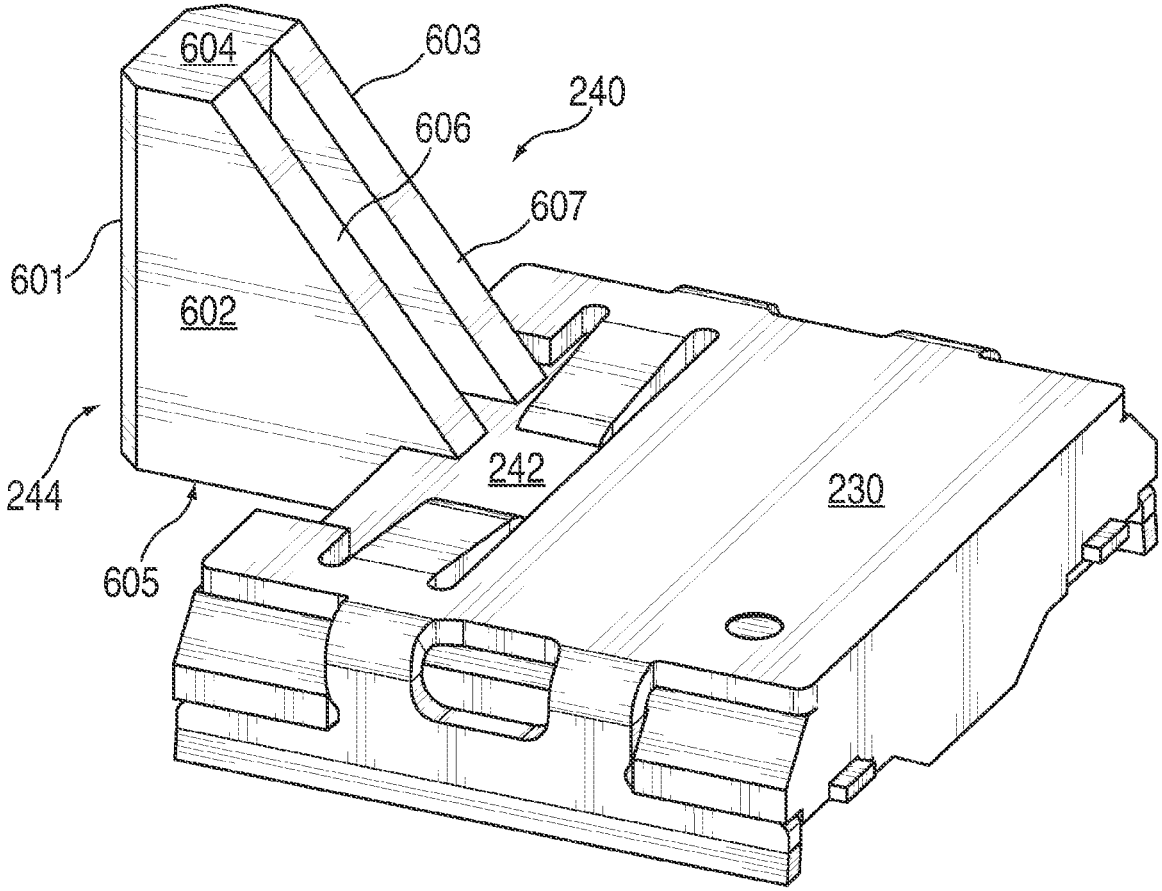
FIG. 6 is an illustrated perspective view of the engagement member and switch box of FIGS. 3 and 4 in accordance with some embodiments of the invention.
Figure 7:
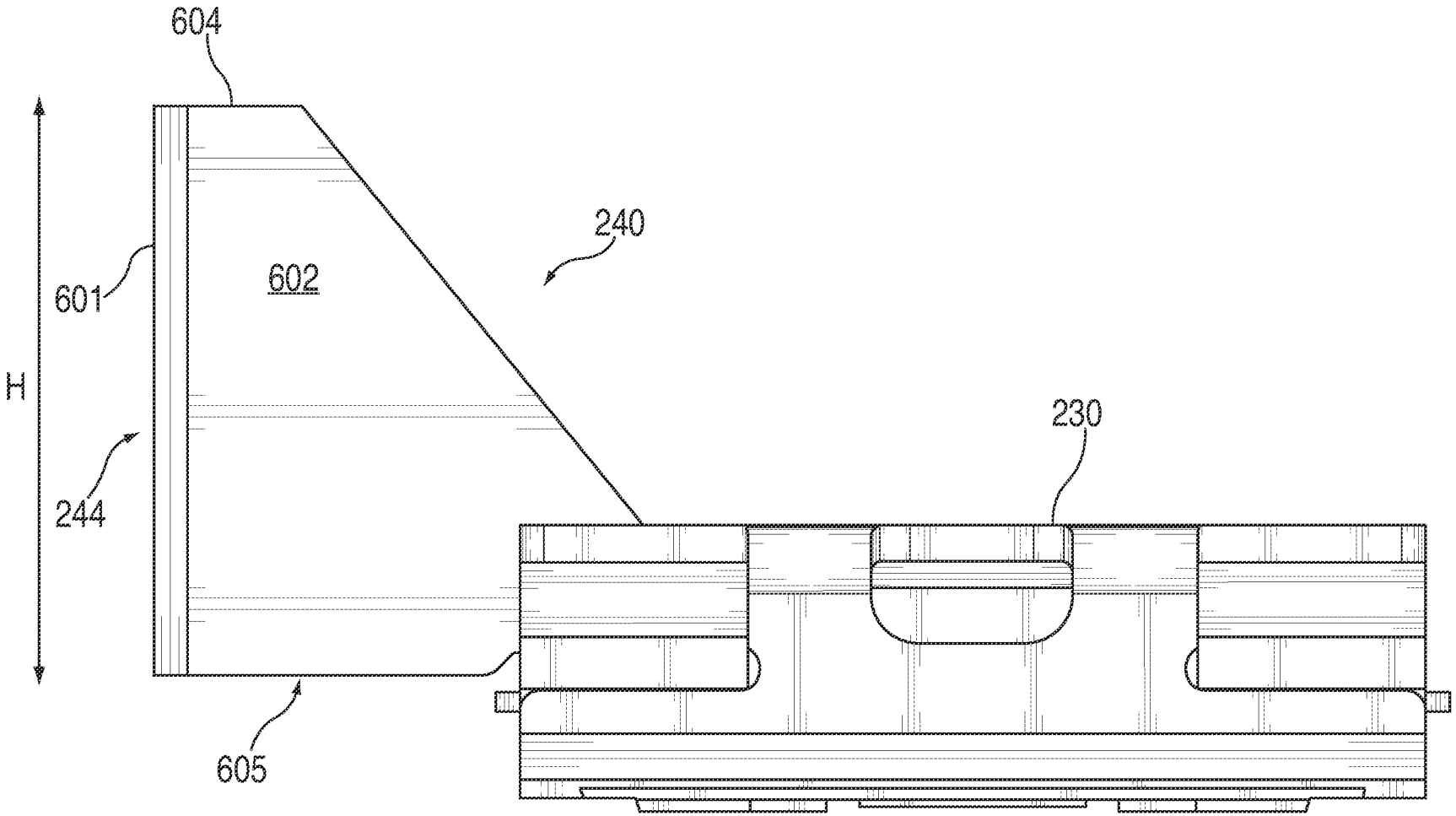
FIG. 7 is an illustrative side view of the engagement member and switch box of FIGS. 3, 4, and 6 in accordance with some embodiments of the invention.

As shown in FIGS. 3-5, for example, switch assembly 200 may also include a switch box 230 coupled to button 214 by button/switch engagement member 240. Switch box 230 may be any suitable switching component, such as an electromechanical switching component, that can translate the mechanical movement of button 214 along track 212 into associated electrical signals to be interpreted by other components of electronic device 10 for potentially altering a functional state of device 10. For example, switch box 230 may include button/switch engagement member 240 and two or more switch contact portions 234 (see, e.g., switch contact portion 234 of FIG. 5). Engagement member 240 may be coupled to button 214 (e.g., via pins 250), and engagement member 240 may move along a switch path between different switch contact portions 234 of switch box 230 when button 214 correspondingly moves between different button positions along track 212. Each switch contact portion 234 of the switch path of switch box 210 may be electrically coupled to an electronic component (e.g., a processor (not shown)) of device 10, for example, via a circuit board 400 of device 10. When button 214 is at a functional button position along track 212, engagement member 240 may thereby contact a respective switch contact portion 234 associated with that functional button position, and switch box 230 may thereby change the function or logic of an electronic component of device 10 that is electrically coupled to that switch contact portion 234 (e.g., via circuit board 400 coupled to box 230).

In some embodiments, switch 230 of switch assembly 200 may be any type of switching component, including, but not limited to, a single pole single throw ("SPST") switch, a single pole double throw ("SPDT") switch, a single pole center off ("SPCO") switch, a double pole single throw ("DPST") switch, a double pole double throw ("DPDT") switch, a double pole center off ("DPCO") switch, a maintained contact switch, a momentary contact switch, a fader or limitless contact switch, or combinations thereof.

Referring to FIG. 3, dashed line 301 is shown passing through the center of button 214 (which in this figure, moves in and out of the page along track 212). Dashed line 301 represents the ideal fulcrum point for engagement member 240 to be coupled to button 214. However, electronic component 300 (e.g., a display screen module) is positioned within device 10 in a manner that prevents switch box 230 and engagement member 240 from being positioned any closer to the ideal fulcrum point. Dashed line 302 passes through the center of switch box 230, and as shown, due to electronic component 300, dashed lines 301 and 302 are offset from each other. This offset causes more torque or strain to be exerted on engagement member 240 than would otherwise be exerted if dashed lines 301 and 302 were co-aligned. Accordingly, engagement member 240 is structurally enhanced to compensate for the extra strain it will endure during normal use of device 10.

Figure 8:
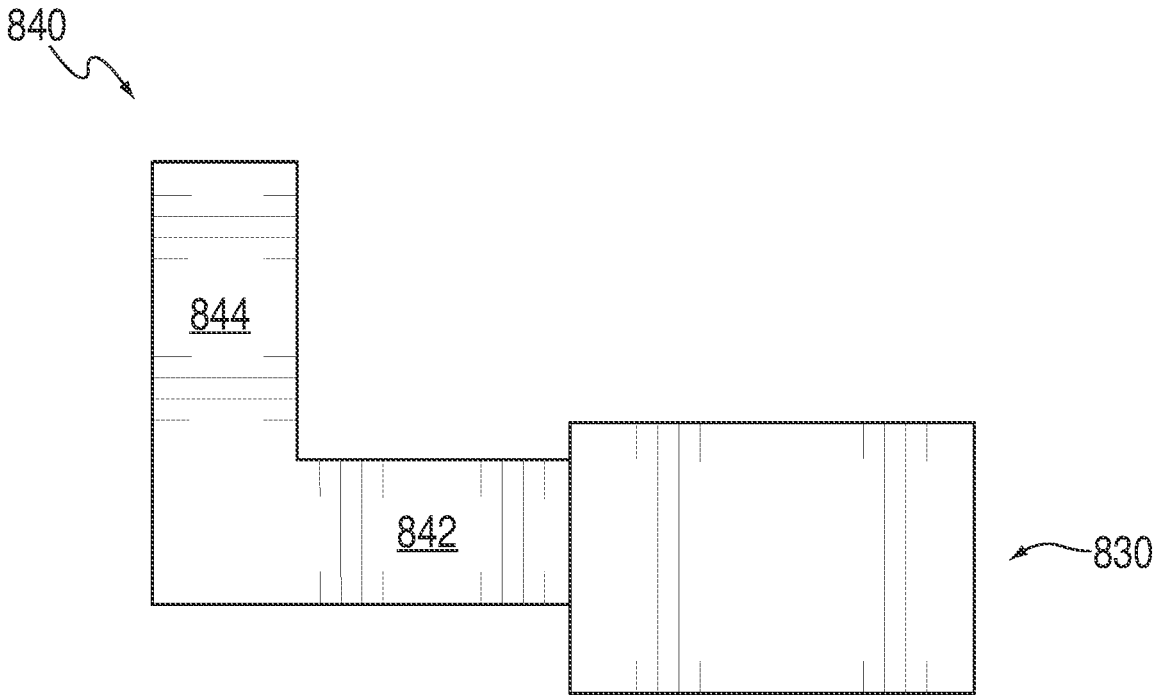
FIG. 8 is an illustrative side view of an L-shaped engagement member in accordance with some embodiments of the invention.
Figure 9:
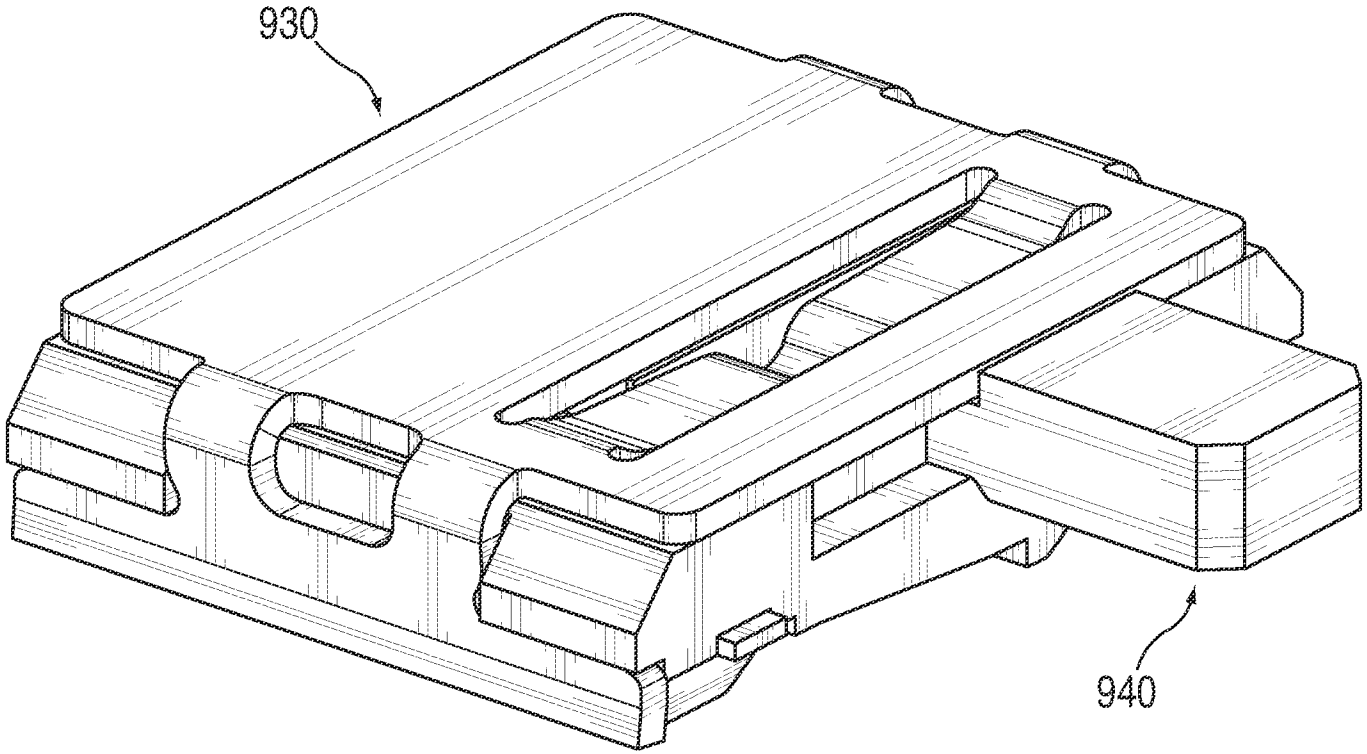
FIG. 9 is an illustrative perspective view of an engagement member in accordance with some embodiments of the invention.
Figure 10:
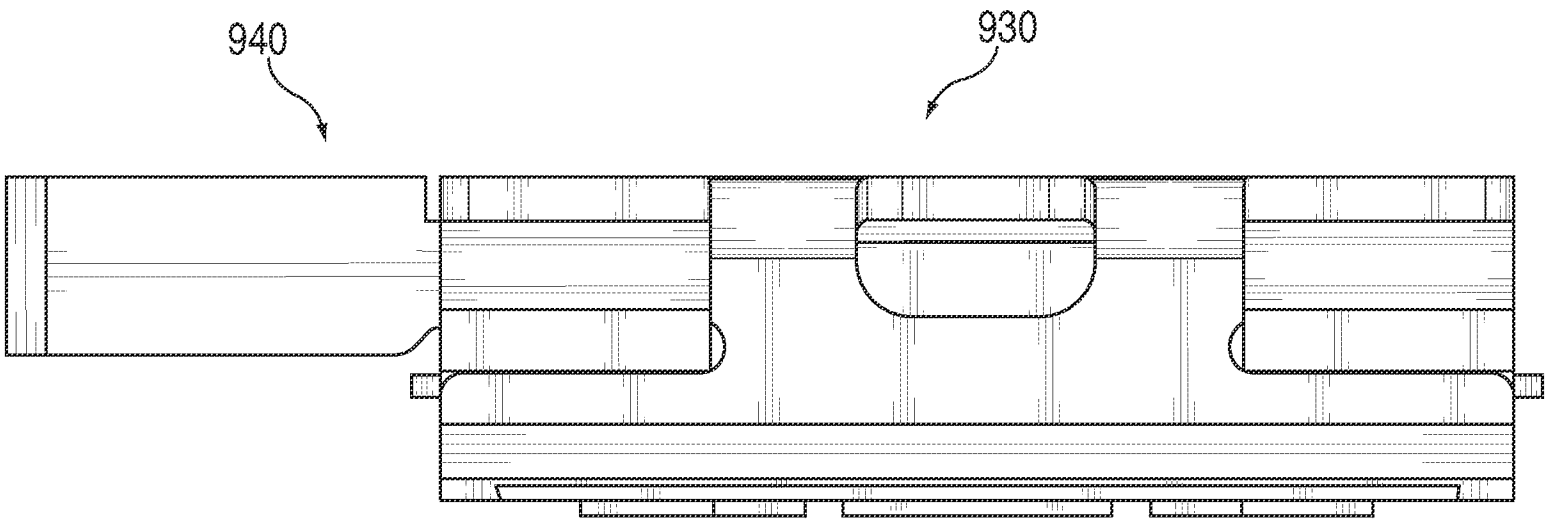
FIG. 10 is an illustrative side view of the engagement member of FIG. 9 in accordance with some embodiments of the invention.

A net result of the use of structurally enhanced engagements members such as engagement member 240 and other engagement member embodiments discussed in FIG. 8-10 is that no portion of button 214 cants or rotates when switched from one position to another. For example, as shown in FIG. 2, the edges of button 214 are parallel to the edges of outer periphery member 12 when in position 212A. When button 214 is moved from position 212A to position 212B, that parallelism is maintained throughout the movement of button 214 along track 212. This fluid and uncompromised button movement is accomplished (using engagement members according to embodiments of this invention) even though switch box 230 is located offset from the center of button 214.

Structural enhancement can be achieved in a number of suitable different ways. One such structurally enhanced engagement member 240 is shown in FIGS. 3, 4, 6 and 7. In these figures, engagement member 240 has a triangular shape and is sometimes referred to as a gusset. Engagement member 240 can include box interface portion 242, which contains switch contact portions 234, and gusset portion 244, which is integrated with box interface portion 242. Box interface portion 242 may be the part of engagement member 240 that fits within switch box 230, whereas gusset portion 244 extends away from box 230 and interfaces with pins 250 (shown in FIG. 4) on button 214.

Gusset portion 244 has button interface sides 601 (which mounts flush against button 214), 602 (which interfaces with one of pins 250), and side 603 (which interfaces with another one of pins 250). When gusset portion 244 is coupled to button 214, pins 250 may fit flush against sides 602 and 603 such that, for example, there is little or no slop in the coupling. Gusset portion 244 has a predetermined height, H, as measured from top side 604 to bottom side 605. Any suitable height H may be used. In one embodiment, the height can extend up to or beyond dashed line 301 (of FIG. 3).

Gusset portion 244 also includes triangular sides 606 and 607 which can span from top side 604 to box interface portion 242. Because two triangular sides 606 and 607 exist, a gap may exist between those sides. If desired, sides 606 and 607 could be combined to produce a gusset portion with a single triangular side. In another embodiment, a rigidity-enhancing member (e.g., a metal member) could be secured in the gap to further structurally enhance engagement member 240.

FIG. 8 shows an illustrative side view of engagement member 840 in accordance with an embodiment of the invention. Engagement member 840 is coupled with switch box 830 and both member 840 and box 830 can function in a manner similar to member 240 and box 230. As shown, engagement member 840 has a L-shape construction and may be constructed from any suitable material such as plastic. In some embodiments, the plastic material can be structurally enhanced with a rigidity-enhancing member such as a piece of metal.

Engagement member 840 can have horizontal portion 842 and vertical portion 844. Part of horizontal portion 842 may fit inside of switch box 830 but also extends away from switch box 830. Vertical portion 844 interfaces with a button such as button 214 and pins such as pins 250.

FIGS. 9 and 10 show illustrative views of a switch box 930 having an engagement member 940 constructed in accordance with an embodiment of the invention. As shown, engagement member 940 has a more horizontally biased profile as compared to engagement members 240 and 840.

Referring now to FIG. 5, spring member 500 and its interaction with engagement member 240, and in particular to contact switch positions 234, is discussed. As discussed above, when button 214 is switched from one position to another, this movement is translated to engagement member 240, which results in member 240 sliding to correspondingly different locations within switch box 230. When member 240 slides from one position to another, spring arm 502 engages one of switch contact positions 234.

Spring arm 502 can be constructed to have a pre-load force for engaging contact positions 234 in a manner that is strong enough to eliminate any slop in the movement of engagement member 240 from one position to another. As used herein, "slop" in engagement member movement can be characterized as the wiggling of the engagement member that is created when a small amount of force is applied to the engagement member, where the applied force is insufficient to cause the engagement member to move to a different switch contact position 234.

Figure 11A:
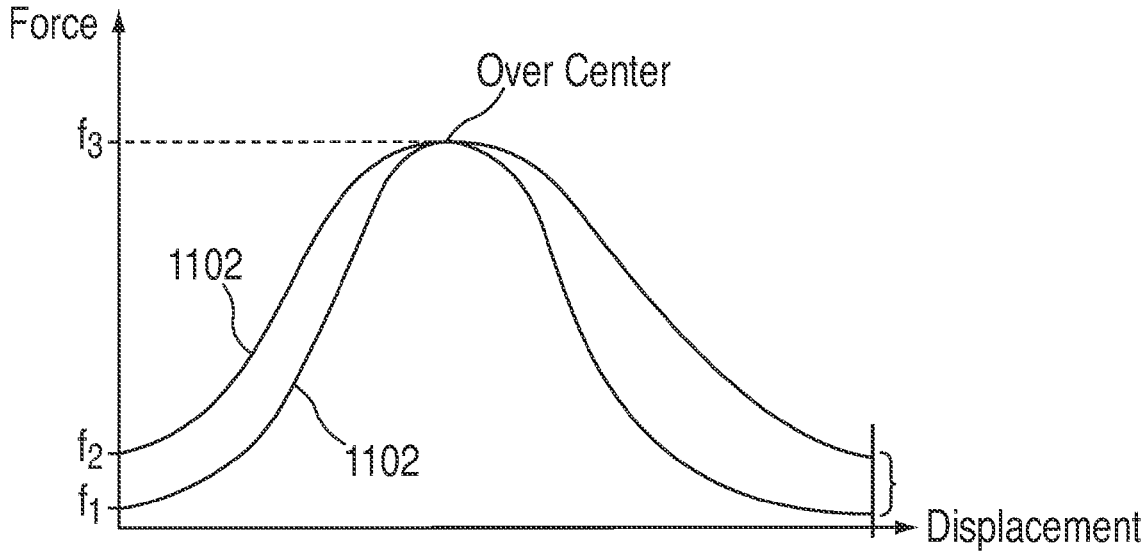
FIGS. 11A-B show illustrative force versus displacement graphs in accordance with some embodiments of the invention.

For example, when the pre-load force of spring arm 502 is below a pre-determined threshold, the engagement member can experience displacement-force curves 1101 and 1102, as illustrated in the graphs of FIG. 11A. As shown, the x-axis represents displacement of engagement member and the y-axis. When the engagement member is situated at a first switch position and a user applies a small amount of force to the button (e.g., a force in the range between $f_1$ and $f_2$), the engagement arm (and consequently the button) may wiggle slightly without sliding to a different switch contact position. This can create slop in the movement of the button. When the applied force eventually reaches a pre-determined threshold (e.g., a pre-determined threshold of $f_3$), the engagement member reaches an over-center point and moves to a different switch position.

Figure 11B:
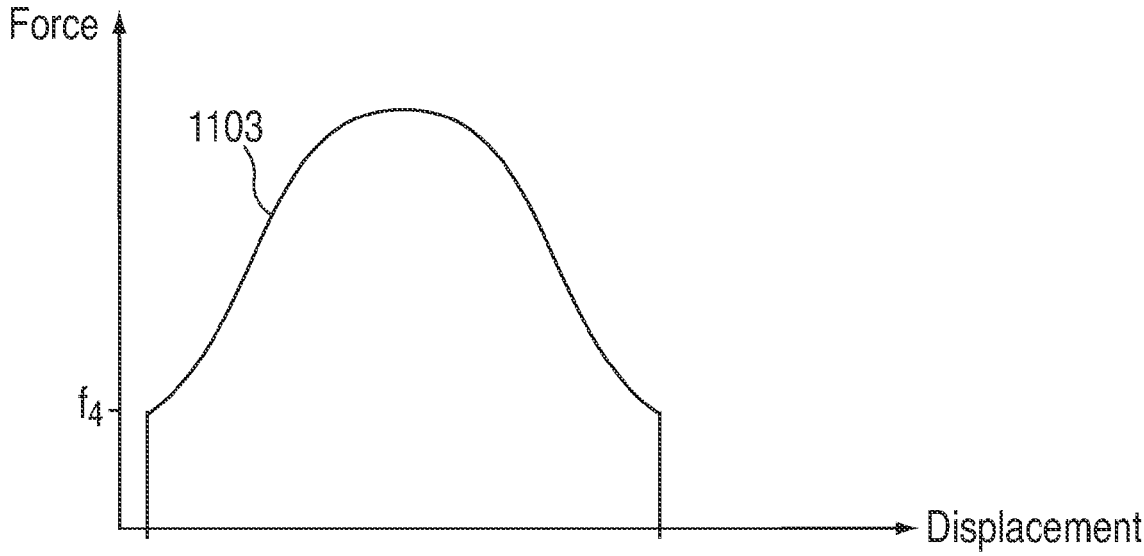

When the pre-load force of spring arm 502 is at or above a pre-determined threshold, slop can be reduced or eliminated. For example, as shown in FIG. 11B, a strong spring can generate displacement-force curve 1103. In some embodiments, spring arm 502 can be configured such that it is fully compressed when the slider is in one of the switch contact positions. That is, the spring would otherwise touch the base if the engagement member was not positioned underneath the spring are. By using the strong spring to hold the slider in place, there can be a hard stop in displacement once the slider has reached a functional position. As such, slight changes in the applied force will not result in slop movement of the engagement arm.

FIGS. 12A-12D show illustrative views of the backside of different buttons, each having different pin configurations for interfacing with an engagement member in accordance with embodiments of the invention. Each button (e.g., buttons, 1210, 1220, 1230, and 1240) has center y-axis 1201, center x-axis 1202, and back plate 1203. In addition, each button has pins that either form a coupled connection (e.g., buttons 1210 1220, and 124) or decoupled connection (e.g., buttons 1230) with the engagement member. In a coupled connection, the pins apply a substantial wide planar surface interface to each side of the engagement member. In a decoupled connection, the pins apply a relatively narrow planar interface to each side of the engagement member.

The engagement member can vary in height from relatively short (e.g., engagement member 940 of FIG. 10) to relatively high (e.g., engagement members 240 or 840). Depending on the height of engagement member and the sizing and coupling configuration of the pins, the amount of twisting or rotation the button experiences when switching from one position to another may vary. For example, referring to FIG. 12A, button 1210 has a relatively short engagement member 1214 (e.g., engagement member 940 of FIG. 9), and short arm coupling pins 1216. Note that member 1214 and pins 1216 are positioned off center with respect to y-axis centerline 1201 of button 1210. Thus, when a user moves button 1210 from one position to another, button 1210 may have a tendency to pivot, thereby potentially preventing button 1210 from exhibiting a fluid and parallel transition.

Figure 12B:
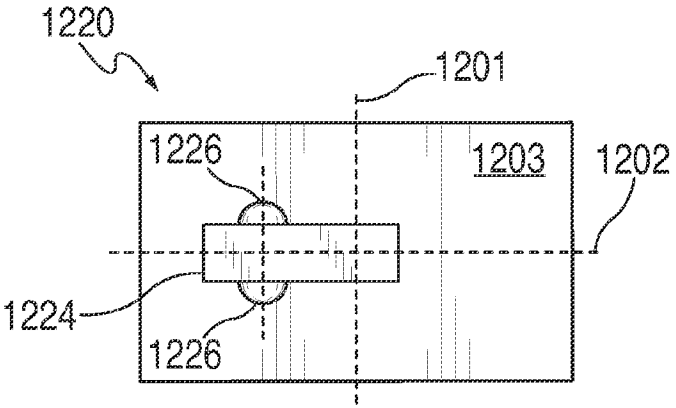
FIG. 12A-D show buttons with different pin configurations in accordance with some embodiments of the invention.
Figure 12A:
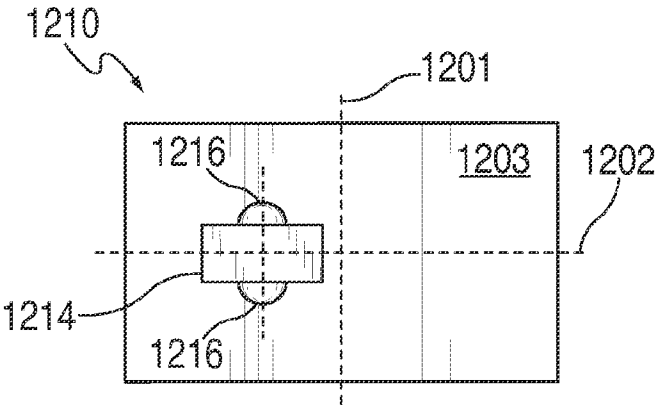

FIG. 12B shows button 1220 having relatively high engagement member 1224 (e.g., engagement 240 or 840) and short arm coupling pins 1226. Member 1224 and pins 1226 are positioned off center with respect to y-axis centerline 1201 of button 1220. Although the height of engagement member 1224 is longer than engagement member 1214, short arm coupling pins 1226 can lack sufficient coupling area to prevent button 1220 from potentially pivoting when switched from one position to another.

Figure 12D:
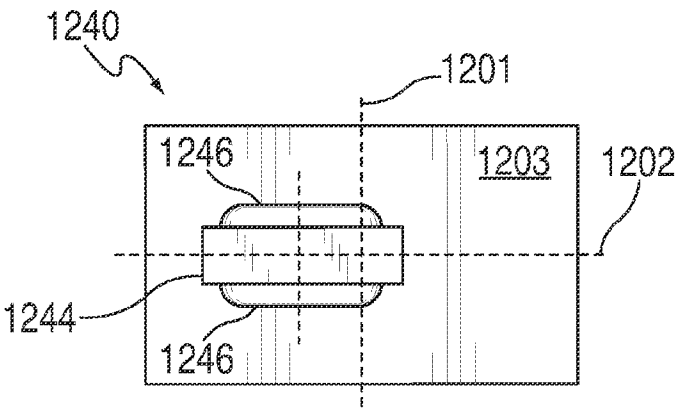

FIG. 12D shows button 1240 having relatively high engagement member 1244 and long arm coupling pins 1246. Member 1244 and pins 1246 are positioned off center with respect to y-axis centerline 1201 of button 1240. Here, the interface coupling area between pins 1246 and member 1242 is greater than that provided in buttons 1210 and 1220. The interface coupling area of button 1240 may accommodate at least forty, fifty, or sixty percent of the available interface area of a relatively high engagement member. This interface can be very effective in mitigating or eliminating the potential for any button rotation when button 1240 is switched from one location to another.

Figure 12C:
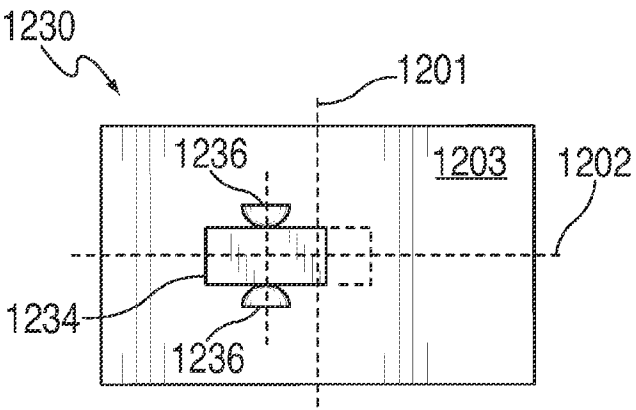

FIG. 12C shows button 1230 having either a relatively short or high engagement member 1234 and decoupled pins 1236. By substantially decoupling the movement of the button from engagement member 1234, engagement member 1234 may no longer twist in response to movement of button 1230. However, there may be insufficient engagement of button 1230 to the engagement member 1234, which can cause button 1230 to move around loosely. If desired, a mechanism may be added to limit the movement of the button. For example, a guide rail (not shown) may be added in order to limit the movement of button 1230.

It is be understood that various directional and orientational terms such as "up" and "down," "front" and "back," "left" and "right," "top" and "bottom," "above" and "under," and the like are used herein only for convenience, and that no fixed or absolute directional or orientational limitations are intended by the use of these words. For example, the devices of the invention can have any desired orientation. If reoriented, different directional or orientational terms may need to be used in their description, but that will not alter their fundamental nature as within the scope and spirit of the invention. Moreover, it is also to be understood that various types of devices, other than electronic devices, may be provided with one or more switch assemblies of the invention. For example, any mechanical device, such as a board game, may be provided with switch assemblies of the invention.

Those skilled in the art will appreciate that the invention can be practiced by other than the described embodiments, which are presented for purposes of illustration rather than of limitation.

What is claimed is:

1. A switch assembly, comprising: a button having a center axis, the button operative to move to one of at least two positions along a track axis; a switch box having a center axis that is offset with respect to the center axis of the button, the switch box comprising a spring member; and an engagement member coupled to the button and to the switch box, the engagement member comprising at least two contact switches, each of which correspond to a respective one of the at least two positions, and is operative to move along an axis parallel to the track axis in response to movement of the button to one of the positions, wherein the spring member interfaces with the contact switch corresponding to the position of the button.

2. The switch assembly of claim 1, wherein the track axis is orthogonal to the center axes.

3. The switch assembly of claim 1, wherein the engagement member comprises a switch box interface portion that fits within and is coupled to switch box and a triangular portion that extends away from the switch box and couples to the button.

4. The switch assembly of claim 3, wherein the triangular portion is a gusset portion.

5. The switch assembly of claim 3, wherein the button comprises pins, and wherein the triangular portion interfaces with the pins.

6. The switch assembly of claim 3, wherein the triangular portion comprises a first triangular wall and second triangular wall.

7. The switch assembly of claim 6, further comprising a rigidity-enhancing member disposed between the first and second triangular walls.

8. The switch assembly of claim 1, wherein the engagement member comprises a rigidity-enhancing member.

9. The switch assembly of claim 1, wherein the engagement member has a height that enables a portion of engagement member to meet or exceed the center axis of the button.

10. The switch assembly of claim 1, wherein the engagement member comprises an L-shaped portion that extends away from the switch box and couples to the button.

11. The switch assembly of claim 1, wherein the spring member comprises a spring constant that prevents the engagement member from exhibiting any slop.

12. The switch assembly of claim 1, wherein the spring member prevents the engagement member from moving unless at least minimum quantity of force is applied.

13. The switch assembly of claim 1, wherein the spring member comprises a spring arm that interfaces with one of the switch contacts depending on the position of the button.

14. The switch assembly of claim 1, wherein the button comprises: a back plate; and at least two pins located on the back plate, wherein the at least two pins interface with the engagement member.

15. The switch assembly of claim 14, wherein the at least two pins interface with the engagement member in a coupled configuration.

16. The switch assembly of claim 14, wherein the at least two pins interface with the engagement member in a decoupled configuration.

17. The switch assembly of claim 14, wherein a center axis of the pins is offset with respect to the center axis of the button.

18. The switch assembly of claim 17, wherein the engagement member has a height that enables a portion of engagement member to extend up to or beyond the center axis of the button.

19. The switch assembly of claim 18, wherein the pins extend up to or beyond the center axis of the button.

20. An electronic device, comprising: a housing having a side wall, which has an outside periphery; an electronic component mounted within the housing; a switch assembly mounted within the housing adjacent to the side wall, the switch assembly comprising: a button having a first portion that extends beyond the outside periphery and a second portion that extends into the housing, the button having a center axis that intersects a portion of the electronic component; a switch box located offset with respect to the central axis of the button and adjacent to an edge of the electronic component, the switch box comprising: a movable member including at least two switch contacts; and a spring member operative to selectively engage one of the at least two switch contacts based on the position of the moveable member; an engagement member coupled to the moveable member and the second portion of the button and operative to translate movement of the button to the moveable member.

21. The device of claim 20, wherein the electronic component is a display screen.

22. The device of claim 20, wherein the engagement member comprises a gusset.

23. The device of claim 20, wherein the engagement member comprises a L-shape.

* * * * *